US006983616B2

(12) United States Patent
Halwan et al.

(10) Patent No.: US 6,983,616 B2
(45) Date of Patent: Jan. 10, 2006

(54) CONTROL LOGIC FOR MAINTAINING PROPER SOLUTION CONCENTRATION IN AN ABSORPTION CHILLER IN CO-GENERATION APPLICATIONS

(75) Inventors: Vivek Halwan, Wethersfield, CT (US); Mark E. Marler, Glastonbury, CT (US)

(73) Assignee: UTC Power, LLC, South Windsor, CT (US)

( * ) Notice: Subject to any disclaimer, the term of this patent is extended or adjusted under 35 U.S.C. 154(b) by 6 days.

(21) Appl. No.: 10/736,260

(22) Filed: Dec. 15, 2003

(65) Prior Publication Data

US 2005/0126192 A1 Jun. 16, 2005

(51) Int. Cl.
*F25B 49/00* (2006.01)
*F25B 15/00* (2006.01)

(52) U.S. Cl. ..... 62/141; 62/148; 62/126; 62/142

(58) Field of Classification Search ..... 62/141, 62/148, 126, 142, 497
See application file for complete search history.

(56) References Cited

U.S. PATENT DOCUMENTS 3,137,144 A 6/1964 Kaufman et al.
4,328,679 A 5/1982 Usui
4,665,709 A 5/1987 Perry
5,477,696 A * 12/1995 Takahata et al. ..... 62/148
5,619,859 A 4/1997 Takigawa
5,934,090 A 8/1999 Ozu et al.
2002/0162341 A1 11/2002 Yamazaki

FOREIGN PATENT DOCUMENTS

JP 05248726 A * 9/1993
JP 06174325 6/1994
JP 06 088653 A 7/1994
JP 08 035734 A 2/1996
JP 09 229512 A 1/1998
JP 10300263 A * 11/1998
JP 2002013834 A * 1/2002
JP 2002 013834 A 5/2002

OTHER PUBLICATIONS

International Search Report, Jun. 17, 2005.

* cited by examiner

*Primary Examiner*—Chen Wen Jiang
(74) *Attorney, Agent, or Firm*—Carlson, Gaskey & Olds

(57) ABSTRACT

This application discloses a control logic for maintaining a proper solution concentration within an absorption chiller. Further, safeguards are added to a system control to ensure robust operation when operated in a co-generation application with a heat source such as a micro-turbine, a reciprocating engine, etc. In such applications, in proper management of the heat flow into the chiller from such sources can result in crystallization of the absorption solution, which would be undesirable. Inventive control logic works to minimize such occurrences.

5 Claims, 1 Drawing Sheet

CONTROL LOGIC FOR MAINTAINING PROPER SOLUTION CONCENTRATION IN AN ABSORPTION CHILLER IN CO-GENERATION APPLICATIONS

BACKGROUND OF THE INVENTION

This application relates to a control logic for maintaining proper solution concentration within an absorption chiller, and to add safeguards in system control which will insure robust operation when operated in co-generation applications with heat sources like micro-turbines, reciprocating engines, etc. Improper management of the heat flowing into the chiller from theses sources can result in crystallization of the absorption solution, which is undesirable Refrigerant absorption cycles have been used for decades to provide a cooled or heated water source for environmental temperature control in buildings. As is known, an absorber and an evaporator in a refrigerant absorption cycle selectively receive a concentrated absorption fluid, such as a LiBr solution, and a separate refrigerant (often water), respectively. The absorption fluid selectively dropped onto separate tube sets in the absorber absorbs the refrigerant vapor generated from the evaporator. A dilute solution, containing both the absorption fluid and the refrigerant is then returned to a generator for generating a heated, concentrated absorption fluid. In the generator, a driving heat source drives the refrigerant vapor out of the mixed fluid. From the generator, the absorption fluid and removed refrigerant vapor are separately returned to the absorber and the evaporator, respectively.

The above is an over-simplification of a complex system. However, for purposes of this application, the detail of the system may be as known. Further, while the above-described system provides chilled water, absorption cycles are also utilized to provide heated water for heating of a building. This invention would extend to such systems. For purposes of this application, an absorption chiller and an absorption heater are to be defined generically in the claims as an "absorption solution/refrigerant system." A worker of ordinary skill in the art would recognize the parallel absorption heater systems and how such systems differ from the disclosed chiller system.

A potential problem occurs with absorption chillers if an undesirable amount of heat is allowed to flow into the generator when the chiller is not operating. Generally, if the absorption fluid is not flowing from the generator, as driven by pumps, etc., heat may continue to build in the generator. This rise in heat, without fluid circulation, can cause too much liquid refrigerant being boiled from the absorption solution, resulting in absorption solution crystallization. Essentially, the liquid is boiled out of the solution leaving only the crystallized absorption material (LiBr).

One condition where this un-commanded heat flow into the generator could occur is when the chiller is in standby mode or is shut down. In some conditions, heat may still be delivered into the system due to faulty valve position, or other problems. The absorption solution is no longer being driven from the generator, heat is flowing in and the solution temperature begins to rise, raising the possibility of absorption solution crystallization.

One other problem that could occur would be an electric power failure. An absorption chiller includes a number of pumps for moving the various fluids. At power failure, all of these pumps would stop with traditional wiring and controls. The delivery of heat into the system may or may not stop dependent upon whether the heat is from a turbine, or a furnace, or whether the heat is from a device electrically powered. However, under such conditions, at a minimum even if heat is not flowing into the generator, the solution is still left in the generator once the power fails. This solution thus includes an undesirably high amount of stored thermal energy, which could result in absorption solution crystallization. As an example, at shutdown of an absorption chiller, the fluid continues to be circulated by the pumps for a period of time such that the heat is removed. When the absorption chiller is "shut down" at a power failure, this circulation will not occur, and the normal cool down will not occur, leaving an undesirably hot absorption solution in the generator which boils off refrigerant.

SUMMARY OF THE INVENTION

In a disclosed embodiment of this invention, sensors monitor system temperature. If there appears to be undesirable heat leakage into the chiller, alarms may be delivered to either maintenance personnel within the building or to service personnel via remote monitoring devices.

For purposes of this application, the terms "maintenance personnel" and providing a "warning" to "building maintenance," should be taken generically as either a hard-wired or wireless communication to any personnel, whether dedicated within the building, or a remote independent service provider. That is "maintenance personnel" is not limited in any fashion to the location of the individual, nor to how the warning is communicated.

Alternatively, other corrective action can be taken. As an example, a blower motor may be powered to dump cool air into the source of heat to reduce heat build-up. Further, the control may continue to monitor the system temperature. If the unrequested heat source is not reduced within an appropriate period of time, the control could command some additional bypass valve, upstream of the chiller control, or diverter, valve, to redirect this flow, or it can simply shut down the heat source.

In other features, if there is a loss of system power, and if the source of heat is a turbine or engine driven generator, the control may generate power for operation of the pump, etc., by the turbine such that an appropriate cool down process can occur. Essentially, the system stops the flow of heat into the generator, but continues to utilize the electric power to run the system pumps to move the absorption fluid through the system for a period of time. This provides an appropriate cool down process, cooling the absorption solution to a temperature at which further boiling out of refrigerant is unlikely and where the solution concentration is maintained within allowable limits.

These and other features of the present invention can be best understood from the following specification and drawings, the following of which is a brief description.

DETAILED DESCRIPTION OF THE PREFERRED EMBODIMENT

Figure 1:
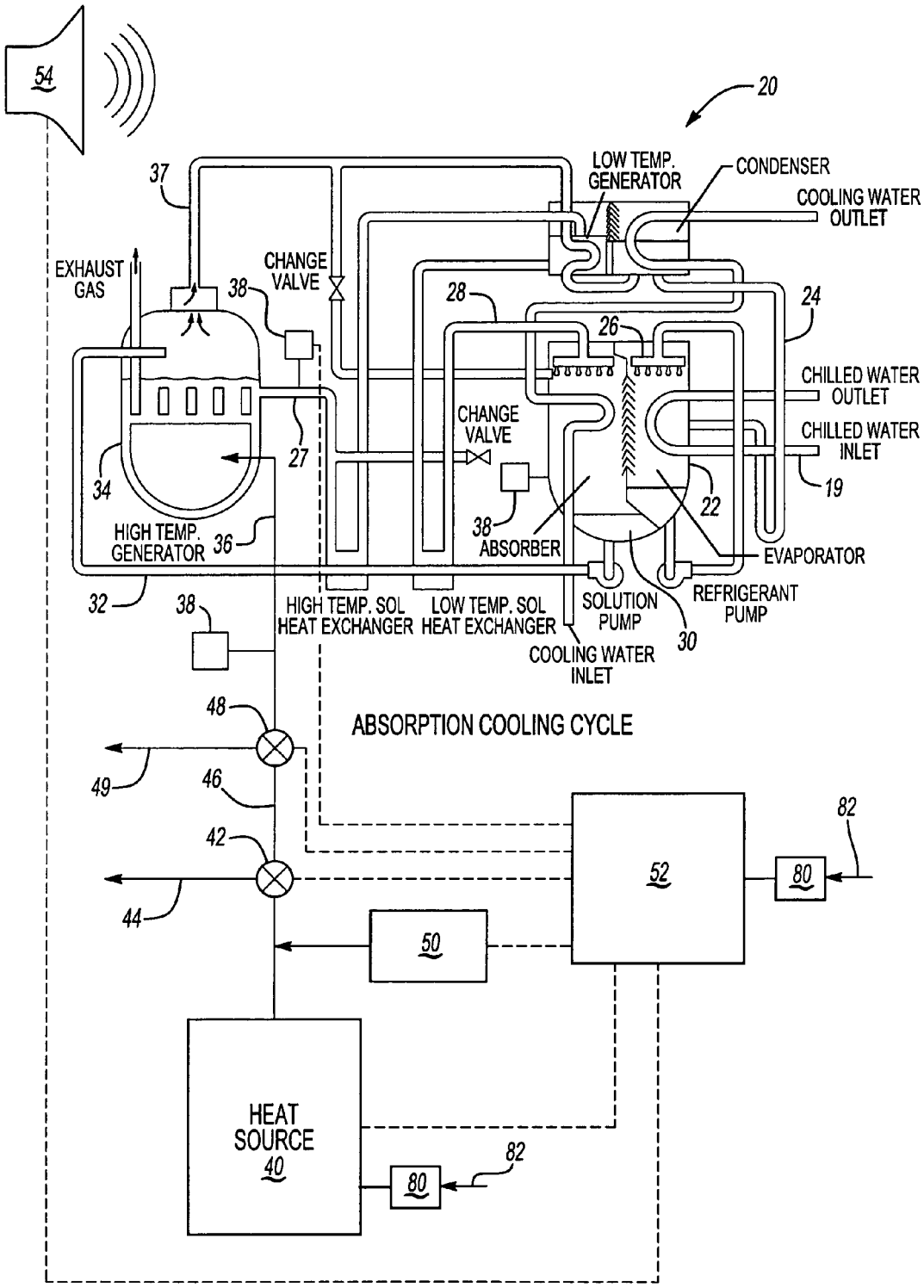
FIG. 1 is a schematic view of an absorption chiller incorporating the present invention.

An absorption chiller system 20 is illustrated in FIG. 1. As shown, an absorber 22 receives flow from a refrigerant line 24. Refrigerant line 24 is delivered through an outlet 26 to drip or fall on a water tube 19. In the event that the system 20 is a chiller, the tube 37 will carry water that is to be cooled, and then utilized to cool environmental air in a building. Alternatively, as mentioned above, the water could be heated, with the refrigerant leaving the line 26 being a heated refrigerant. Again, the details of the change to provide this function are within the skill of a worker in this art.

A second line 28 delivers an absorption solution into the absorber 22. Ultimately, a mixture of the refrigerant and absorption solution, or diluted LiBr solution, gathers at 30, and is returned through a line 32 to a generator 34. A source of heat is delivered through a line 36 into the generator 34. This source of heat boils refrigerant out of the mixture, and into a line 37. A second line 27 delivers the remaining concentrated absorption solution, with lower levels of refrigerant, through a line 28, returning to the absorber 22. This concentrated absorption solution in the line 27 is cooled on the path to the absorber, increasing its ability to absorb the water vapor that is created as the refrigerant evaporates in the "Evaporator."

A sensor 38 is shown on the line 36, with a second sensor shown on line 27. It should be understood that a number of temperature sensors 38 are placed in one or several locations within the system 20. If these sensors determine an undesirable heat load in the system, a control 52 is operable to effect a change.

As an example, control 52 may be operational to control a valve 48 to divert flow from a heat source 40 either to the line 36, or an exhaust dump 49. As an example, co-pending provisional application 60/501,366 discloses an appropriate diverter valve that is operational to provide a particular amount of heated fluid to the line 36.

If the control 52 determines that the amount of heat in the system 20 is undesirably high, then the control 52 can effect a number of further changes. Certainly, it can further close the valve 48, however this may not always be fully effective. If the valve 48 is further close the valve 48, however this may not always be fully effective. If the valve 48 is leaking exhaust, this may be an explanation for the undesirable heat load in the system 20. Thus, the control 52 is provided with other options to further control the amount of heat being delivered into the system.

One option includes a separate, or backup, bypass valve 42, that is normally not operational, but which can be controlled by the control 52 to dump all, or a significant portion of the fluid traveling from the heat source 40 to an atmosphere dump 44. Thus, should the control determine that the valve 48 may be faulty in that the amount of heat determined by the sensors 38 is greater than is desired, it may operate the redundant bypass valve 42.

Alternatively, a cool air blower 50 may be operated by the control 52 to dump cooler air into the flow leaving the heat source 40 such that the amount of heat delivered to the line 36 is reduced.

Also, a warning 54 may be utilized such as by an alarm, electronic signal, etc., delivered to maintenance personnel. This will enable service personnel to control the system to stop the flow of heat into the chiller, or otherwise start a method of diverting unwanted heat. Absorption chillers often have ways of eliminating heat from the system that may be operated dependent upon system capacity. One of these methods may be actuated by maintenance personnel or by the control.

Further, if the heat is not reduced within a particular period of time, the control can command shut down of the heat source 40 in certain embodiments.

The hierarchy of control most preferred would be to initially provide the warning to the alarm 54, then operate the blower 50, then operate the bypass valve 48, then finally shut down the heat source 40. However, other priority levels between these options would come within the scope of this invention.

One other time when the heat detected by the sensor 38 may exceed a desired heat, is when there is a loss of electrical power to the system 20. In such cases, the pumps on the system 20 are no longer operational, as well as the cooling and chilled water pumps. The absorption solution is no longer moved through the system. Thus, the mixture in the generator 34 remains static. This solution may be exposed to an undesirably high temperature for an undesirable period of time. As known, at normal shut down of the system 20, the pumps continue to circulate the fluids such that they cool off gradually and mix with refrigerant appropriately to manage concentration levels. However, in a power failure situation, the pumps will not move the fluid. Under certain conditions, this may result in the mixture being exposed to an undesirable amount of heat, and raises the possibility of absorption fluid crystallization. Preferably, valve 42 is spring biased to close, such that it will be held closed in the event of a loss of electric power.

The present invention is operational to actuate a turbine, which is the preferred heat source 40, to provide electrical power to the pumps through a normal cool down process such that the solution continues to be circulated even though the system 20 is otherwise shut down due to lack of power. Even though the turbines are maintained to provide electrical power, the valve 42 (or 48) may also be actuated to dump all of the outlet heated fluid, or exhaust, into the exhaust dump 44 (or 49).

While the control 52 may be provided with feedback of the need to provide this alternative power simply through the sensor 38. Typically, some other device should be included to provide an indication of the failure of the electrical power to the system 20. Further, the control 52, and preferably the sensors 38, should be provided with some form of back-up power source such that they continue to be operational even if there is a power failure.

As also shown, sensors 80 may be associated with a power inlet line to control 52, and/or turbine 40.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. An absorption solution/refrigerant system comprising:

a generator for receiving a mixture of an absorption solution and a refrigerant, and for receiving a source of heat;

said generator including a line for taking a refrigerant from said generator to an absorber, and for taking said absorption solution from said generator to said absorber separately from said refrigerant, and including a line from said absorber for returning a combined absorption solution and refrigerant mixture to said generator;

a sensor for sensing an undesirable heat load on said system, said sensor providing feedback to a control, said control being operational to effect a device to reduce the heat load on said system should it be determined that an undesirable heat load exists on said system; and said source of heat is a heated fluid source, and said control provides a cool fluid source to be mixed with said heated fluid source should said undesirable heat load be determined.

2. An absorption solution/refrigerant system comprising:

a generator for receiving a mixture of an absorption solution and a refrigerant, and for receiving a source of heat;

said generator including a line for taking a refrigerant from said generator to an absorber, and for taking said absorption solution from said generator to said absorber separately from said refrigerant, and including a line from said absorber for returning a combined absorption solution and refrigerant mixture to said generator;

a sensor for sensing an undesirable heat load on said system, said sensor providing feedback to a control, said control being operational to effect a device to reduce the heat load on said system should it be determined that an undesirable heat load exists on said system;

said control effects control of a valve to further reduce the amount of heat in said system should said undesirable heat load be determined; and said control normally controls a first diverter valve controlling the amount of heated fluid delivered to said generator, and said control controlling a second bypass valve should said undesirable heat load be determined.

3. An absorption solution/refrigerant system comprising:

a generator for receiving a mixture of an absorption solution and a refrigerant, and for receiving a source of heat;

said generator including a line for taking a refrigerant from said generator to an absorber, and for taking said absorption solution from said generator to said absorber separately from said refrigerant, and including a line from said absorber for returning a combined absorption solution and refrigerant mixture to said generator;

a sensor for sensing an undesirable heat load on said system, said sensor providing feedback to a control, said control being operational to effect a device to reduce the heat load on said system should it be determined that an undesirable heat load exists on said system; and said source of heat is an engine powered generator, and said control being provided with an indication from said sensor that there is a power failure in said system, said control then diverting power from said engine powered generator to power at least pumps within said system.

4. An absorption solution/refrigerant system comprising:

a generator for receiving a mixture of an absorption solution and a refrigerant, and for receiving a source of heat;

said generator including a line for taking a refrigerant from said generator to an absorber, and for taking said absorption solution from said generator to said absorber separately from said refrigerant, and including a line from said absorber for returning a combined absorption solution and refrigerant mixture to said generator;

a sensor for sensing an undesirable heat load on said system, said sensor providing feedback to a control, said control being operational to effect a device to reduce the heat load on said system should it be determined that an undesirable heat load exists on said system; and said control effects control of a valve to control the amount of heat delivered by said source of heat, said valve further controlling a blower for mixing a cooled source in with said source of heat, said valve further controlling a warning to building maintenance personnel, said control operating each of said valve, said blower, and said warning in a hierarchy of levels should said undesirable heat load be determined to be continuing.

5. A system as set forth in claim 4, wherein said control further being operational to shut said system down should said undesirable heat load continue even after each of said valve, said blower and said warnings have been effected in response to said undesirable heat load.

* * * * *